US010006216B1

(12) United States Patent
Ronconi

(10) Patent No.: US 10,006,216 B1
(45) Date of Patent: Jun. 26, 2018

(54) ULTRASONIC DESCALING DEVICE

(71) Applicant: RONCONI ACQUISITIONS, LLC, Oro Valley, AZ (US)

(72) Inventor: Robert L. Ronconi, Fort Dodge, IA (US)

(73) Assignee: RONCONI ACQUISITIONS, LLC, Oro Valley, AZ (US)

( * ) Notice: Subject to any disclaimer, the term of this patent is extended or adjusted under 35 U.S.C. 154(b) by 0 days. days.

(21) Appl. No.: 15/382,153

(22) Filed: Dec. 16, 2016

(51) Int. Cl.
*E04H 4/16* (2006.01)
*B08B 7/02* (2006.01)

(52) U.S. Cl.
CPC ..... *E04H 4/1618* (2013.01); *B08B 7/028* (2013.01)

(58) Field of Classification Search
None
See application file for complete search history.

(56) References Cited

U.S. PATENT DOCUMENTS

| | | | | |
|---|---|---|---|---|
| 3,809,977 A | | 5/1974 | Balamuth et al. | |
| 3,937,236 A | | 2/1976 | Runnells | 134/184 |
| 4,041,563 A | * | 8/1977 | Steeves | E04H 4/1681 134/167 R |
| 4,881,978 A | * | 11/1989 | Van Horssen | B08B 7/022 134/16 |
| 5,138,733 A | | 8/1992 | Bock | 15/22.1 |
| 5,718,582 A | | 2/1998 | Quinn et al. | |
| 6,071,260 A | | 6/2000 | Halverson | 604/22 |
| 6,259,653 B1 | | 7/2001 | Courson et al. | 367/141 |

(Continued)

FOREIGN PATENT DOCUMENTS

| | | | |
|---|---|---|---|
| CN | 105755728 | 7/2016 | D06F 7/04 |
| CN | 105755729 | 7/2016 | D06F 7/04 |

(Continued)

OTHER PUBLICATIONS

Ultrasonic Skin Scrubber Spatula for Gentle Peeling, Skin Clean, Ion Therapy and Face Lifting LCD Screen, product description, downloaded from https://www.amazon.com/Utrasonic-Scrubber-Spatula-Peeling-Therapy/dp/B00MTI45AM, Jan. 3, 2017 (1 pg).

(Continued)

*Primary Examiner* — Nicole R Blan
(74) *Attorney, Agent, or Firm* — Hayes Soloway P.C.

(57) ABSTRACT

A portable ultrasonic descaling device provides an improved method to remove calcium deposits and stains from the surfaces of swimming pools and other structures in contact with water. The handheld device comprises a water-resistant housing, within which are mounted an ultrasonic transducer, a fluid pumping system, a cleaning blade, a controller, and a power source. The ultrasonic transducer drives both the pumping system and the cleaning blade. The fluid pumping system draws fluids from a water source and through the device, cooling the transducer, cleaning blade, and surfaces being descaled by fore mounted spray nozzles. The power source comprises batteries to power the device. Lighting may also be fore-mounted for illumination and is connected to the circuitry along with a visual indicator. Direct contact of the calcified buildup with the oscillating cleaning blade and water spray from the nozzle heads causes breakdown of the deposits by cavitation.

9 Claims, 4 Drawing Sheets

(56) References Cited

U.S. PATENT DOCUMENTS

| | | | | |
|---|---|---|---|---|
| 6,619,957 | B1 | 9/2003 | Mosch et al. | |
| 7,908,696 | B2 | 3/2011 | Pareti | 15/1.7 |
| 8,402,585 | B2 | 3/2013 | Rief et al. | 15/1.7 |
| 2002/0189635 | A1 | 12/2002 | Bodet et al. | 134/1 |
| 2005/0120756 | A1 | 6/2005 | Mah | 68/3 SS |
| 2005/0150066 | A1 | 7/2005 | Lin | 15/22.1 |
| 2005/0284190 | A1 | 12/2005 | Fan et al. | 68/3 SS |
| 2007/0166663 | A1 | 7/2007 | Telles et al. | 433/119 |
| 2010/0299852 | A1 | 12/2010 | Fayyad | 15/1.7 |
| 2011/0047726 | A1 | 3/2011 | James | 15/1.7 |
| 2012/0298566 | A1 | 11/2012 | Eli et al. | 210/85 |
| 2015/0147717 | A1* | 5/2015 | Taylor | A61C 17/0205 433/80 |

FOREIGN PATENT DOCUMENTS

| | | | |
|---|---|---|---|
| EP | 1143841 | 10/2001 | A47L 13/17 |
| EP | 1232026 | 4/2005 | B08B 3/12 |
| WO | WO 0028874 | 5/2000 | |
| WO | WO03033179 | 4/2003 | B08B 3/12 |
| WO | WO2007033109 | 3/2007 | |
| WO | WO2009048271 | 4/2009 | A61H 23/02 |
| WO | WO2014172420 | 10/2014 | E04H 4/16 |

OTHER PUBLICATIONS

KINGA Facial Skin Ultrasonic Scrubber SPA Gentle Peel Dermabrasion Skin Rejuvenation Anti-Age Device, product description, downloaded from https://www.amazon.com/KINGA-Ultrasonic-Dermabrasion-Rejuvenation-Chargeable/dp/B00XUI9PPU, Jan. 3, 2017 (1 pg).

Wang, J., Applications of Sonicator/Ultrasonic Processor, Ultrasonic Technical Information, Sep. 7, 2014 (2 pgs).

International Search Report and Written Opinion issued in corresponding PCT International Patent Application Serial No. PCT/US2017/066819, dated Feb. 15, 2018 (9 pages).

* cited by examiner

ULTRASONIC DESCALING DEVICE

FIELD OF THE DISCLOSURE

The present invention relates to ultrasonic cleaning devices for removing calcium deposits from surfaces using ultrasonic waves. The invention has particular utility as a device for removing scale and encrustation buildup from swimming pools and other structures that are in contact with water, and will be described in connection with such utility, although other utilities are contemplated.

BACKGROUND OF THE DISCLOSURE

There exist many types of manual and automatic swimming pool cleaners on the market. Automatic pool cleaners can be the built-in type or use an umbilical attachment and use suction, water pressure, or robotic devices to perform their cleaning tasks. These generally operate on their own using suction or water pressure, scrubbing brushes, filters, or water jets to keep the floors and walls clean. They are effective in removing both particulate and large debris. Manual pool cleaners are mostly mounted to long poles and require vigorous back and forth or circular scrubbing of the surfaces by hand to be useful. They can range from vacuum-type cleaners to water brooms, wall brushes, and hand mitts. In a comprehensive pool maintenance program, routine use of both automatic and manual methods is required to keep the surfaces clean and tidy.

Disadvantages of most automatic cleaners are that they do not scrub the surfaces of the swimming pool's walls, that they can have their movement range limited by the length of electrical cords and hoses, and that they may need additional pumps or plumbing to be installed. While robotic cleaners generally do a good job of scrubbing and debris removal, they require more maintenance of internal pumps and filters, typically should be removed before swimming to prevent cord damage, and are quite costly. Manual cleaners operation can be time consuming, monotonous, and cumbersome. Some manual devices also require regular replacement of filters or parts, which adds to costs, and may be limited to relatively short use times by their rechargeable batteries. Both the automatic and manual methods of cleaning are ineffective and inadequate once calcifications have started to accumulate.

Inevitably, even a well cared-for and scrubbed pool will eventually begin to develop calcium deposits. Swimming pool scale, which primarily consists of calcium carbonate, typically builds up fastest on the sidewalls and waterline areas where evaporation occurs, and also on steps, metal hand rails, and water features. Once the scale appears, it is very tenacious and difficult to remove. This requires additional expense in materials, labor, time, and sometimes environmentally caustic measures to clear it away.

To treat most visible scale buildup, common methods include draining the pool or spa, blasting the surfaces with abrasive powder and power-washing. These methods can be expensive requiring costs of refilling the pool, new chemicals, and the service expense. There also are environmental concerns with the powder overspray, noise during the pumping of the water, power washing, or powder spraying, and in dumping thousands of gallons of pool water and chemicals out into the surroundings.

Other methods of cleaning scale buildup involve using disposable products such as enzyme cleaners, pumice stones and cleaning blocks, acids, stain and phosphate removers, algae and metal treatment chemicals. Pumice stones or scrub brushes can be used in conjunction with muriatic acid; the acid is applied to the limescale for a certain amount of time, then scrubbed to remove the buildup. This method is not only difficult to accomplish on sidewalls and various surfaces that have the build up, but can be hazardous to a user's lungs, skin, eyes, and mouth due to the harsh nature of the acid. The acid can cause pitting of metal surfaces. Transporting and home storage of this toxic and dangerous chemical is another troubling aspect to consider. Moreover, even with intense scrubbing of the encrusted surfaces with acid and mechanical contact by stone or brush, it is not an effective or efficient means to remove the scale. The toxic sludge eventually works its way into the pool water, which can leave mounds of sediment on the pool bottom and water chemistry changes that need to be dealt with.

The use of ultrasonics in cleaning began in the 1950s, primarily in industrial applications, e.g., for manufacturing in the medical, automotive, aircraft, and munitions fields. As its popularity grew, so did its applications and usage. Ultrasonics was found to be very effective in removing surface contaminants while being non-toxic and non-harmful to that which was being cleaned. In a process called cavitation, ultrasonic waves travel through water or fluid and the vibrations tear at the fluid creating very small bubbles which are formed due to alternating pressures. When these bubbles implode, they release immense temperatures and pressures in a high velocity jet-like focus onto the surface they are directed at. Because of their small size and high energy, they can break up the contaminants on surfaces in normally difficult areas to access and clean. Ultrasonic technology can be used to clean various nonporous surfaces of dust, dirt, rust, oil, grease, carbon, limescale, bacteria, algae, wax, pigments, and other buildup.

Some pool cleaning assemblies use ultrasonic generators that are built into automatic pool cleaners. The combination of ultrasonic waves, rotating brushes, and suctioning capabilities provides increased efficacy in cleaning contaminated surfaces and hard to reach areas. However, these devices are expensive, difficult to handle, and not portable.

U.S. Pat. No. 6,259,653 describes a portable, diver-operated, encapsulated underwater ultrasonic cleaner for removing rust, scale, paint, and marine growth from underwater surfaces. It is advantageous in its design to clean underwater surfaces. However, it only operates underwater, not at or above the waterline where the most visible calcium deposits form. Additionally, it is a large device, and would be impractical for small-scale residential or commercial use from both economic and maneuverability standpoints.

Also described in the art are various hand held ultrasonic cleaning devices which are used for removing soils and stains from household items and clothing (WO 2003033179 A1, EP1143841 (A2), US 20020189635 A1, EP1232026 B1, US 20050150066 A1, CN 105755728 A, US 20050120756 A1, US 20050284190 A1), and for removal of horny substances from skin (WO 2009048271 A1), and cordless ultrasonic dental scalers for use on dental patients (U.S. patent application Ser. No. 11/624,675). These portable devices all utilize ultrasonic wave generation for removal of unwanted buildup of various types, but none are suitable for use in a swimming pool.

Thus, a heretofore unaddressed need exists in the industry to address the aforementioned deficiencies and inadequacies.

SUMMARY OF THE DISCLOSURE

Embodiments of the present disclosure provide a device and method for descaling pools. Briefly described, in architecture, one embodiment of the device, among others, can be implemented as follows. At portable, self-contained ultrasonic descaling device is provided. The device comprises a water-resistant housing having an interior and an exterior. Located within the interior of the housing are an ultrasonic transducer, and a fluid pumping system for pumping a cooling fluid, e.g., water to cool the ultrasonic transducer. A cleaning blade is connected to the ultrasonic transducer to move according to a motion of the ultrasonic transducer, and extends out from the housing. The fluid pumping system is driven by the motion of the ultrasonic transducer. Additionally, a controller is located within the housing, the controller being in electrical communication with the ultrasonic transducer. Finally, a power source is in electrical communication with the ultrasonic transducer, the fluid pumping system, and the control circuitry.

The present disclosure can also be viewed as providing methods of removing buildup from the sides of a pool. In this regard, one embodiment of such a method, among others, can be broadly summarized by the following steps: providing an ultrasonic descaling device comprising a water-resistant housing having an interior and exterior, an ultrasonic transducer, a cleaning blade connected to the ultrasonic transducer, wherein the cleaning blade moves according to the motion of the ultrasonic transducer, a fluid pumping system for pumping a cooling fluid, e.g., water, to cool the ultrasonic transducer, wherein the fluid pumping system is driven by the motion of the ultrasonic transducer, a controller in electrical communication with the ultrasonic transducer, and a power source in electrical communication with the ultrasonic transducer, the fluid pumping system, and the control circuitry, wherein the ultrasonic transducer, cleaning blade, fluid pumping system, and controller are housed within the water-resistant housing, and wherein the cleaning blade extends out from the housing; providing the ultrasonic descaling device as above described; connecting the ultrasonic descaling device to a fluid source; activating the ultrasonic descaling device; sweeping the blade of the ultrasonic descaling device across the surface of the buildup desired to be removed; and repeating the sweeping step until the buildup has been removed.

Other devices, systems, methods, features, and advantages of the present disclosure will be or become apparent to one with skill in the art upon examination of the following drawings and detailed description. It is intended that all such additional devices, systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

One embodiment of the present invention is of a portable ultrasonic descaling device that utilizes ultrasonic energy to break up calcium deposits and stains from swimming pools and surfaces that come in contact with water, and enhance removal of calcifications, biologics, and algae from said surfaces.

Figure 1A:
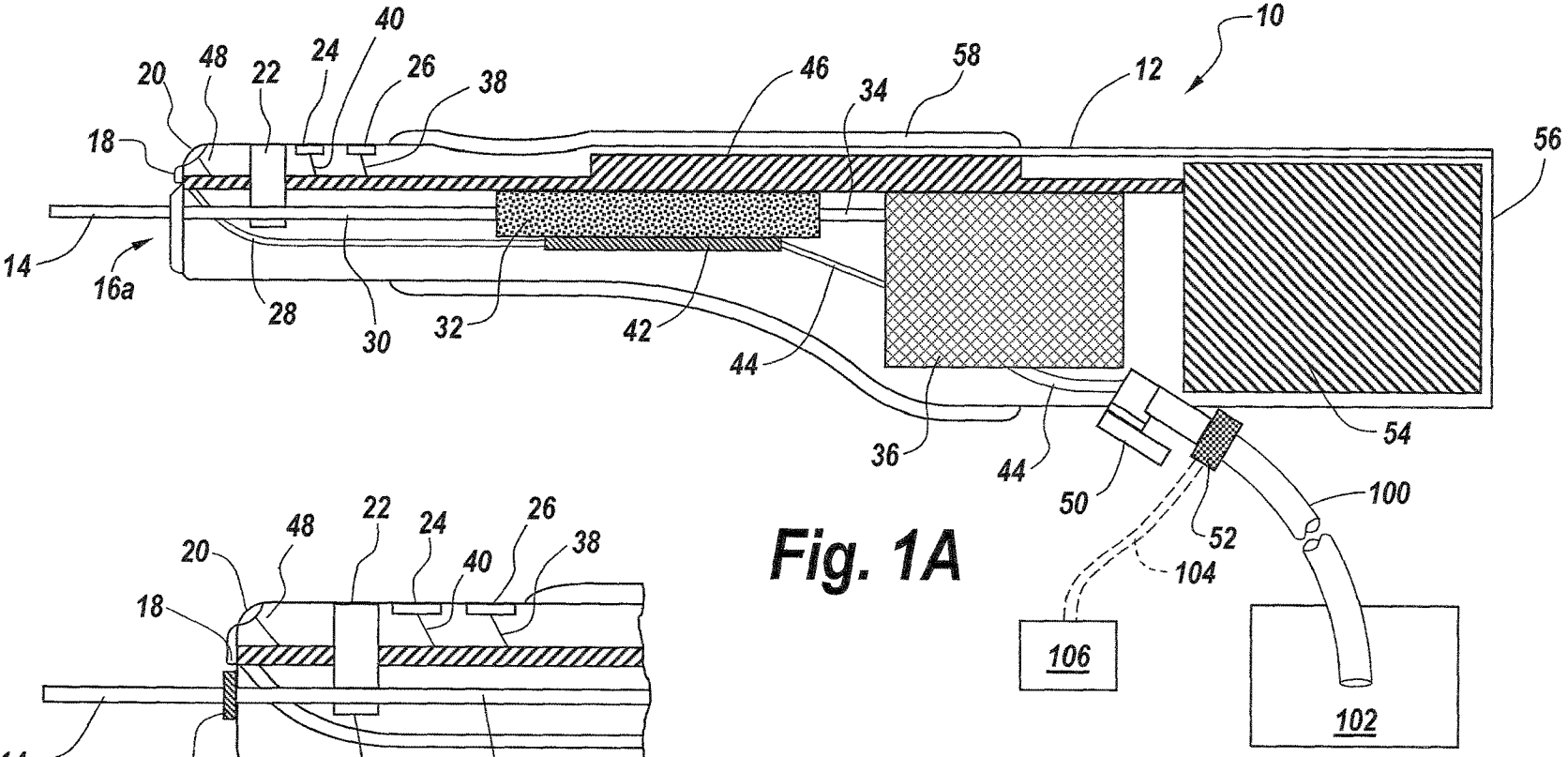
FIG. 1A is a cross-sectional schematic view of the portable ultrasonic descaling device with an exchangeable head according to an embodiment of the present invention.
Figure 1B:
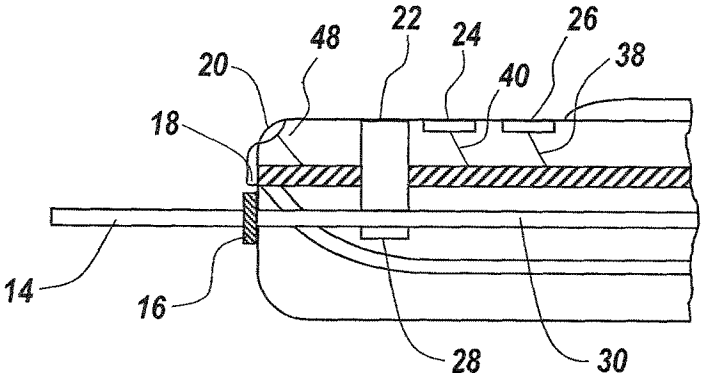
FIG. 1B is a cross-sectional schematic view of the portable ultrasonic descaling device with an O-ring design according to an embodiment of the present invention.

The portable ultrasonic descaling device, as shown in FIGS. 1-3, has a contoured design that is held in the hand of an operator and applied to surfaces to be cleaned. FIGS. 1A-B are cross-sectional schematic views of the device 10 with exchangeable head design and O-ring designs, respectively. The device 10 comprises a water-resistant housing 12 that contains the functional components of the device 10 within. Within the housing there is arranged a controller 46, ultrasonic transducer 32, fluid pumping system 36, power source 54, and a cleaning blade 14. Covering the mid-portion of the device 10 is a grippable surface 58, which is discussed in more detail in FIG. 3.

In use, the device 10 is held in the hand of the operator, and through an opening in the fore-end of the housing a cleaning blade 14 protrudes whiles being irrigated by fluid from spray nozzle 18. The cleaning blade 14 may be pressed against or swept along an area desired to be cleaned. The cleaning blade 14 may extend several inches from the housing 12 so that the operator can see the area being cleaned. The cleaning blade 14 may be made from any material suitable for withstanding ultrasonic vibrations. Preferably, the cleaning blade 14 is made from a material that will not damage tile and grout during use, such as hard plastics or soft metals. The blade is firmly affixed in the housing by the push button chuck 22 and may be interchangeable with blades of various sizes and shapes designed for specific tasks. Alternatively, other locking schemes may be used to hold the blade against the housing. In FIG. 1A, the cleaning blade 14 is contained in an exchangeable head 16*a* which affixes to the fore of the unit to connect with the ultrasonic radiating structure. In this embodiment, the exchangeable head 16*a* seals the fore-end of the device 10 to keep water from getting inside the housing 12. In FIG. 1B the cleaning blade 14 is placed in the push button chuck 22 similar to the way a drill bit is loaded into a drill. In this embodiment, an O-ring 16 between the cleaning blade 14 and the housing 12 prevents water from getting inside the housing.

The cleaning blade 14 is mechanically coupled to the ultrasonic transducer 32 by contact with linkage 30. Linkage 30 is an ultrasonic radiating structure which is preferably a straight bar that operates in a linear fashion, but other configurations and motions that transmit mechanical forces are contemplated.

During use of the device 10, ultrasonic waves are generated by the ultrasonic transducer 32. The ultrasonic transducer 32 may be a piezoelectric actuator, and conjugated by linkage 30 to the cleaning blade 14. Ultrasonic waves can be transmitted through water or air to contact and break apart buildup. The piezoelectric actuator, such as a piezo stack actuator, reacts to a voltage waveform by warping its crystalline structure, which is used as mechanical power by displacement. Its movement is strong, fast, and precise with meager energy usage. The displacement is in direct correlation to the actuator's structure and applied voltage whereby oscillating the voltage produces vibrating forces and movement. Alternatively, the ultrasonic transducer 32 may be an electromagnetic transducer or other actuator that causes vibrations and displacements within the housing. In some embodiments, the device may comprise more than one type of transducer or multiple transducers of the same type.

The byproduct of the very high frequency oscillations of the ultrasonic transducer 32, linkages 30, 34, and cleaning blade 14 is heat. To mitigate that heat, the present invention may include a heat sink 42 made of appropriate thermoconductive material, such as copper. In a preferred embodiment of the invention, the heat sink 42 is a fluid heat sink that uses water or other fluid to cool the device 10. The fluid heat sink is controlled by the fluid pumping system 36.

The fluid pumping system 36 is powered by the ultrasonic transducer 32 through a linkage 34. The pumping system 36 draws fluid by means of a conduit 44 which is attached to an adjustable flow rate valve 50 and a fluid inlet/connector 52. An externally-connected tubing can be fitted to the descaling device by the fluid connector to provide its fluid source. For example, a garden hose connected to a water spigot provides a preferred source of fluid. In one embodiment, the fluid source may be a portable container of water. In another embodiment, the fluid inlet/connector 52 connects to a hose 100 that draws water from the pool 102 being cleaned. In still yet another embodiment, the fluid source is also connected via a hose 104 (shown in phantom) to a container 106 that mixes in additional substances, such as descaling agents, pool treatment chemicals, and the like. The pumping system 36 drives the fluid from the source through the fluid inlet/connector 52 and flow rate valve 50 through conduits 44, 28, such as piping or tubing, to the spray nozzles 18 whereby the fluid cools and debrides the cleaning blade 14 and working field. The fluid pumping system 36 may be of a diaphragm type, micropump, or miniature pump run by a linkage with the actuator and the flow of fluid (e.g., water) may be controlled by a flow rate valve 50 and/or a variable power switch 24.

A controller 46 controls the operation of the device 10 by distributing electrical power to the components within the housing 12. The controller 46 is provided within the housing 12 and is electrically connected to the ultrasonic transducer 32, fluid pumping system 36, and a power source 54. Additionally, wiring 38, 40, and 48 connects the controller 46 to other fore-end elements such as the visual indicator 26, power switch 24, and light source 20, which are discussed in greater detail in FIGS. 2A-B. The controller 46 may be circuitry comprising a piezoelectric actuator that incorporates a piezo voltage driver, energized by the power source, producing a signal at a pre-selected frequency. The controller 46 may further include a detecting circuit that can be adapted to receive and monitor feedback signals from the ultrasonic transducer 32 to vary the voltage waveform. The art, the controller 46 also may include a monitoring device or safety system in the event of water incursion into the unit.

A power switch 26 is provided on the fore-end of the device 10. The power switch 26 has at least two states, on and off, which control the flow of electricity to the ultrasonic transducer 32. In a preferred embodiment, the power switch 26 is variable, with additional settings to regulate a variable amount of electricity to the ultrasonic transducer 32. This governs the oscillation of the ultrasonic transducer 32, thereby controlling the speed and amount of subsequent movement of linkages to the cleaning blade and pumping system. In embodiments with a variable power switch 26, the flow rate valve 50 of the fluid pumping system 36 may be optional, as the variable movement of the ultrasonic transducer 32 may sufficiently control the flow of fluid through the device 10. The power switch 26 is of a water-resistant design that impedes fluids from entering the housing 12.

A power source 54 is provided in a compartment within the housing 12 and can be energized with batteries of a disposable or rechargeable type having a sealed access door 56 and connected to control circuitry. The access door may 56 have a safety shut-off switch (not shown) to prevent operation of the descaler if door is ajar. One embodiment of the portable ultrasonic descaler may contain circuit components, GFI system, transformers, and internal connections to allow AC current to provide its power and subsequent changes to the housing 12 to allow for an electrical cord to be attached.

Figure 2A:
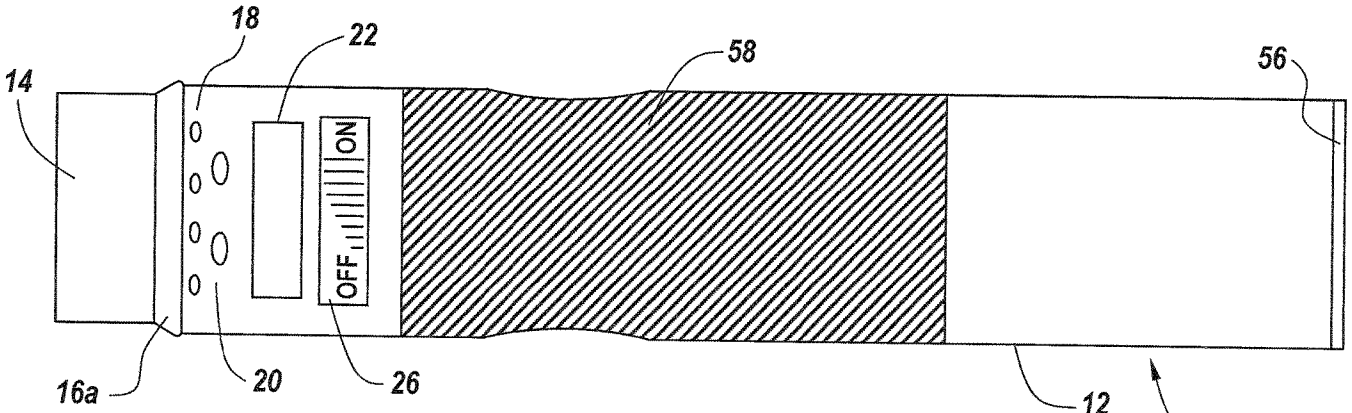
FIG. 2A is a top view of the portable ultrasonic descaling device with an exchangeable head design according to an embodiment of the present invention.
Figure 2B:
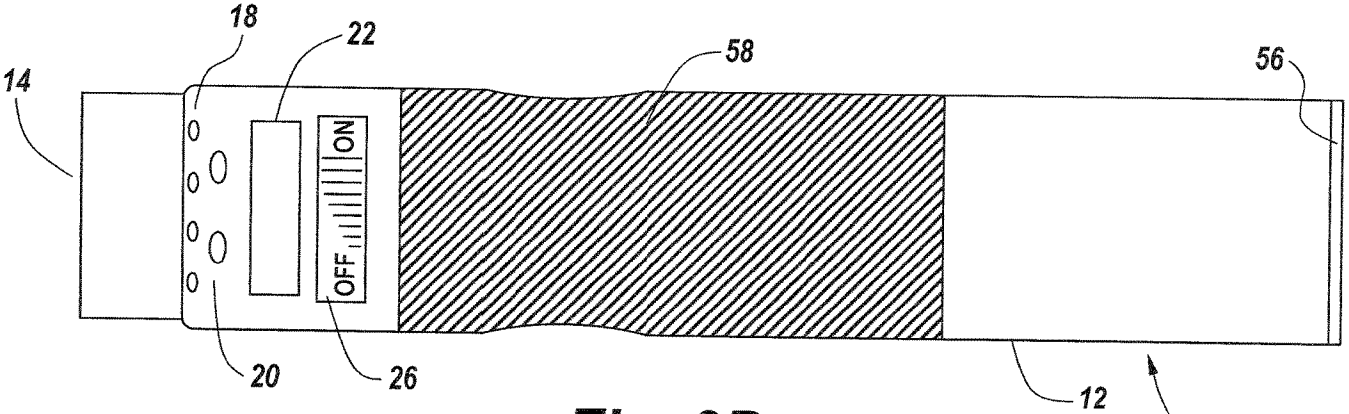
FIG. 2B is a top view of the portable ultrasonic descaling device with an O-ring design according to an embodiment of the present invention.

FIGS. 2A-B show top views of the device 10 with exchangeable head design and O-ring designs, respectively. Referring to FIG. 2A, the fore-end of the device 10 comprises the cleaning blade 14 situated within the exchangeable head 16*a*. Referring to FIG. 2B, the fore-end of the device 10 comprises the descaling blade 14 only.

Near the fore-end of the device 10 are spray nozzles 18, light source 20, push-button chuck 22, and a power button 26. The spray nozzles 18 may appear as one or multiple holes in the top of the housing 12 and oriented toward the front end of the cleaning blade 14. In one embodiment, the nozzles 18 are positioned to extend slightly outward from the housing 12. The light source 20, which is connected to the control circuitry 48, may be included to illuminate the cleaning blade 14 and working field. The light source 20 may be light emitting diodes (LEDs), fiber optic illumination, incandescent bulbs, or any suitable source of light. In a preferred embodiment, the light source 20 illuminates while the device 10 is on. In an alternate embodiment, light source 20 may be turned on and off by an additional switch or button (not shown) located on the housing 12. The light source 20 may be set into the housing to repress fluid penetration while in use. The device 10 also may comprise a visual indicator 26 on the exterior of the housing 12. The visual indicator 26 is connected to circuitry 38 and may display information relaying the operating status of the device 10 (off/on), the charge remaining in the battery, the amount of operating time remaining on the device, or the intensity level of the cleaning blade 14. Other information relevant to operation of the device may be displayed as well. The visual indicator 26 should be water-resistant and housed partially within the housing. The visual indicator 26 may be an LCD screen, LEDs, organic LEDs, printed text or pictures, or some combination of the above.

Figure 3A:
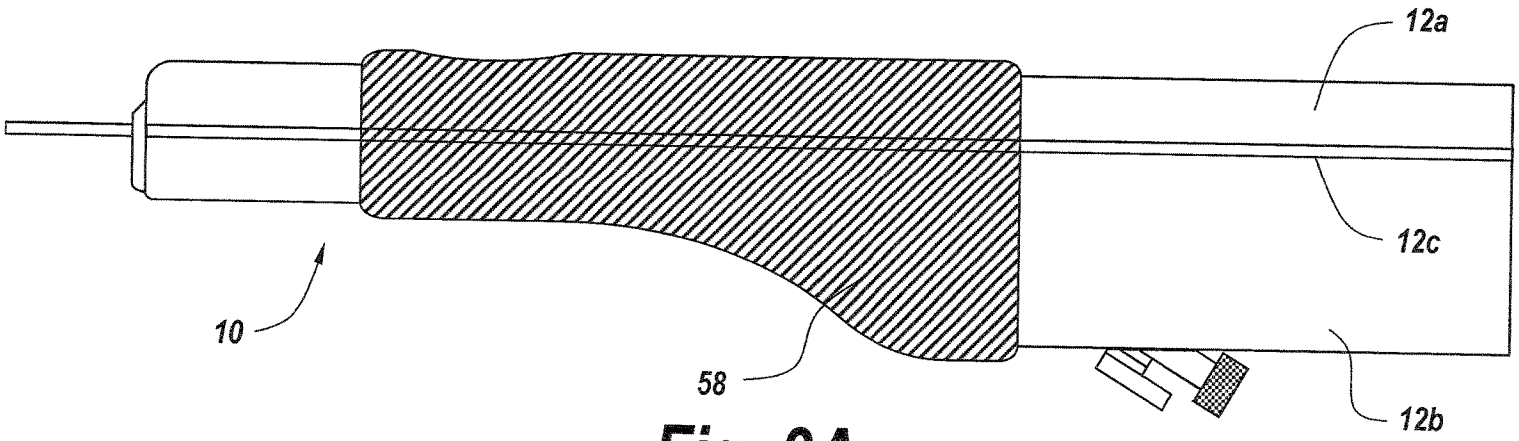
FIG. 3A is a left side view of the portable ultrasonic descaling device with an exchangeable head according to an embodiment of the present invention.
Figure 3B:
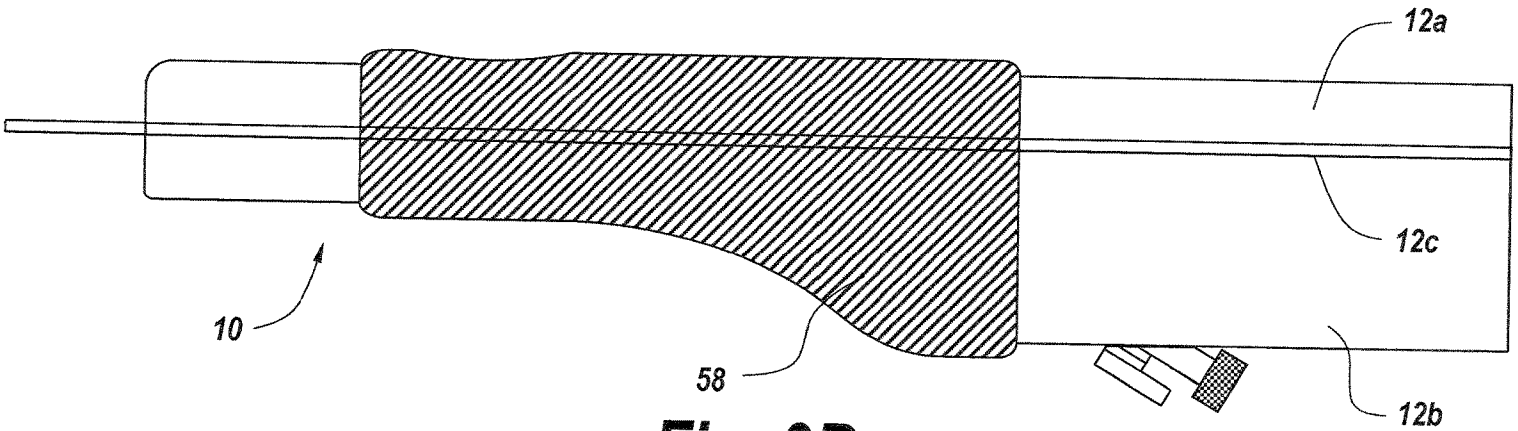
FIG. 3B is a left side view of the portable ultrasonic descaling device with an O-ring design according to an embodiment of the present invention.

The mid and rear portions of the device 10 comprise the grippable surface 58, which is discussed in FIGS. 3A-B, and the sealed access door 56. The sealed access door 56 may be made from the same material as the housing 12, discussed in more detail below, and provides a water-resistant seal for the electronic components housed within the device 10.

FIGS. 3A-B show left side views of the portable ultrasonic descaling device 10 with exchangeable head design and O-ring designs, respectively. The water-resistant housing of the device 10 is formed of an upper part 12*a* and a lower part 12*b*, a sealing gasket 12*c*, and covered by a grippable surface 58. The housing forms a shell that encompasses the internal components discussed in FIGS. 1A-B above. The housing may be formed from any suitable material that provides a rigid structure and prevents water or other fluids from entering the device 10. Such materials include, but are not limited to, plastics such as polyvinyl chloride and polyethylene teraphthalate. The shell may be cast in pieces 12*a*, 12*b* and sealed with sealing gasket 12*c* upon assembly of the device 10. In an alternate embodiment, pieces 12*a* and 12*b* may be cast as a unitary housing without the sealing gasket 12*c*.

The mid-portion of the device 10 is covered by a grippable surface 58. The grippable surface 58 assists an operator in holding and maneuvering the device 10 while in use. The grippable surface 58 may be made from the same material as the housing 12*a*, 12*b*, and the surface may simply be textured or shaped so as to provide increased holding power for the operator. In one embodiment, the gripping surface 58 may be made from a separate material having a lower hardness than the housing, such as rubber or foam. The gripping surface 58 should be highly water-resistant, and may be covered in a hydrophobic coating in some embodiments. The gripping surface 58 may wrap around the entire circumference of the mid-portion of the device 10, as shown in FIGS. 3A-B. Alternatively, the gripping surface 58 may wrap around only a portion of the device 10 as required to accommodate an operator's hand.

Figure 4:
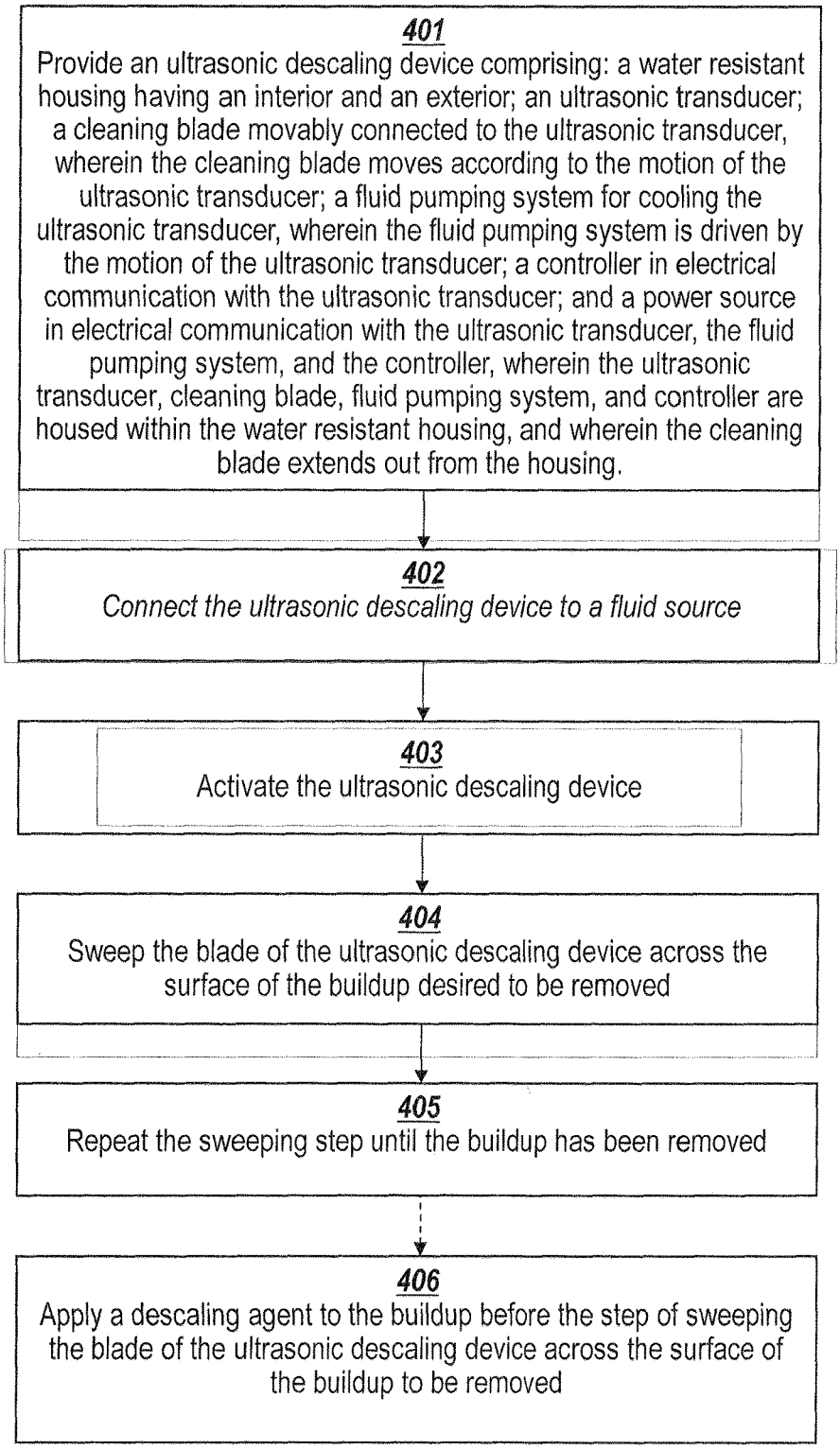
FIG. 4 is a flow chart of a method for a method for removing buildup from the sides of a pool.

FIG. 4 is a flow chart showing a method for removing buildup from the sides of a pool. In step 401, an ultrasonic descaling device is provided as above described, e.g., comprising a water resistant housing having an interior and an exterior; an ultrasonic transducer; a cleaning blade movably connected to the ultrasonic transducer, wherein the cleaning blade moves according to the motion of the ultrasonic transducer; a fluid pumping system for cooling the ultrasonic transducer, wherein the fluid pumping system is driven by the motion of the ultrasonic transducer; a controller in electrical communication with the ultrasonic transducer; and a power source in electrical communication with the ultrasonic transducer, the fluid pumping system, and the controller, wherein the ultrasonic transducer, cleaning blade, fluid pumping system, and controller are housed within the water resistant housing, and wherein the cleaning blade extends out from the housing. In step 402, the ultrasonic descaling device is connected to a water source. In step 403, the ultrasonic descaling device is activated. In step 404, the blade of the ultrasonic descaling device is swept across the surface of the buildup desired to be removed. Finally, in step 405, the sweeping step in repeated until the buildup has been removed. In one embodiment, additional step 406 teaches applying a descaling agent to the buildup before the step of sweeping the blade of the ultrasonic descaling device across the surface of the buildup to be removed. Such descaling agents are well known in the art. The descaling agent may be applied to the area to be cleaned and left on the area for a time before the device is used. This may chemically assist in the removal of buildup by first breaking down the buildup.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An ultrasonic descaling device for a swimming pool, comprising:

a water-resistant housing;

an ultrasonic transducer;

a cleaning blade connected to the ultrasonic transducer, wherein the cleaning blade moves according to the motion of the ultrasonic transducer;

one or more spray nozzles directed toward the cleaning blade;

a water inlet/connector, and a conduit adapted to connect the water inlet/connector and the swimming pool;

a water pumping system for circulating water from the swimming pool past the ultrasonic transducer for cooling the transducer, and to the one or more spray nozzles wherein the water pumping system is driven by the motion of the ultrasonic transducer;

a controller in electrical communication with the ultrasonic transducer; and a power source in electrical communication with the ultrasonic transducer, the water pumping system, and the controller, wherein the ultrasonic transducer, cleaning blade, water pumping system, and controller are located within the water-resistant housing, and wherein the cleaning blade extends out from the housing.

2. The ultrasonic descaling device of claim 1, wherein the cleaning blade is replaceable.

3. The ultrasonic descaling device of claim 2, wherein the cleaning blade is secured to the device by a push button chuck.

4. The ultrasonic descaling device of claim 1, wherein the power source is a battery.

5. The ultrasonic descaling device of claim 1, further comprising a light source on an exterior of the housing.

6. The ultrasonic descaling device of claim 1, further comprising at least one visual indicator on the exterior of the housing.

7. The ultrasonic descaling device of claim 1, wherein the water inlet/connector is also adapted to be connected to a source of descaling agents and/or swimming pool treatment chemicals.

8. A method for removing buildup from the sides of a pool, comprising the steps of:

providing the ultrasonic descaling device of claim 1;

connecting the ultrasonic descaling device to the pool;

activating the ultrasonic descaling device;

sweeping the blade of the ultrasonic descaling device across the sides of the pool of the buildup desired to be removed; and repeating the sweeping step until the buildup has been removed.

9. The method of claim 8, further comprising the step of applying a descaling agent to the buildup before the step of sweeping the blade of the ultrasonic descaling device across the sides of the pool of the buildup desired to be removed.

* * * * *